US008042557B2

(12) United States Patent
Berner et al.

(10) Patent No.: US 8,042,557 B2
(45) Date of Patent: Oct. 25, 2011

(54) MULTITANK CONVEYOR-TYPE DISHWASHER AND AN OPERATING METHOD FOR IT

(75) Inventors: Dietrich Berner, Waldstetten (DE); Klaus Padtberg, Offenburg (DE); Harald Disch, Elzach (DE)

(73) Assignee: Premark FEG L.L.C., Wilmington, DE (US)

( * ) Notice: Subject to any disclaimer, the term of this patent is extended or adjusted under 35 U.S.C. 154(b) by 1063 days.

(21) Appl. No.: 11/909,722

(22) PCT Filed: Mar. 28, 2006

(86) PCT No.: PCT/US2006/011231

§ 371 (c)(1),
(2), (4) Date: Sep. 26, 2007

(87) PCT Pub. No.: WO2006/107650

PCT Pub. Date: Oct. 12, 2006

(65) Prior Publication Data

US 2009/0277477 A1 Nov. 12, 2009

(30) Foreign Application Priority Data

Apr. 2, 2005 (DE) ..... 10 2005 015 157

(51) Int. Cl.
*B08B 3/02* (2006.01)

(52) U.S. Cl. ..... 134/60; 134/72; 134/131

(58) Field of Classification Search ..... 134/60, 134/72, 131

See application file for complete search history.

(56) References Cited

U.S. PATENT DOCUMENTS

| | | | | |
|---|---|---|---|---|
| 2,564,798 | A * | 8/1951 | Allensworth | 134/60 |
| 3,789,860 | A * | 2/1974 | Katterheinrich et al. | 165/47 |
| 3,849,197 | A * | 11/1974 | Sorrentino | 134/10 |
| 4,319,930 | A * | 3/1982 | Yano et al. | 134/10 |
| 4,326,551 | A * | 4/1982 | Voorhees | 134/58 D |
| 4,357,176 | A * | 11/1982 | Anthony | 134/18 |
| 4,561,904 | A | 12/1985 | Eberhardt, Jr. | |
| 5,038,807 | A * | 8/1991 | Bailey et al. | 134/57 D |

(Continued)

FOREIGN PATENT DOCUMENTS

DE 712150 * 1/1934

(Continued)

OTHER PUBLICATIONS

International Preliminary Report on Patentability issued regarding International Application No. PCT/US2006/011231 (Oct. 3, 2007).

(Continued)

*Primary Examiner* — Frankie L Stinson
(74) *Attorney, Agent, or Firm* — Thompson Hine LLP

(57) ABSTRACT

Multitank conveyor-type dishwasher (2) for washing items (10) to be washed, comprising at least two wash zones (6, 8) which are arranged in succession in the conveying direction (4); a liquid forward-flow apparatus (26) between in each case two successive wash zones (6, 8) for transferring liquid between these wash zones (6, 8) in a forward-flow direction (28) counter to the conveying direction (4); characterized in that a liquid recirculation apparatus (60) is provided for transferring sprayed liquid of a front wash zone (8), as seen in the conveying direction (4), into a rear wash zone (6) which is arranged downstream of the front wash zone (8), as seen in the conveying direction (4), counter to the forward-flow direction (28).

11 Claims, 3 Drawing Sheets

U.S. PATENT DOCUMENTS

| | | | | |
|---|---|---|---|---|
| 5,287,866 | A * | 2/1994 | Torimitsu et al. | 134/44 |
| 5,356,483 | A * | 10/1994 | Saalmann et al. | 134/25.2 |
| 6,536,060 | B1 * | 3/2003 | Janssens et al. | 8/159 |
| 2002/0020435 | A1 | 2/2002 | Varpio | |
| 2004/0118435 | A1 | 6/2004 | Jung et al. | |

FOREIGN PATENT DOCUMENTS

| | | | |
|---|---|---|---|
| DE | 712150 | | 10/1941 |
| DE | 4311064 | | 4/1993 |
| EP | 0838190 | A2 | 4/1998 |
| EP | 0838190 | B1 | 4/1998 |
| EP | 0980669 | | 2/2000 |
| EP | 1046370 | | 10/2000 |
| WO | 83/01187 | | 4/1983 |
| WO | 91/07904 | | 6/1991 |
| WO | 94/23286 | | 10/1994 |

OTHER PUBLICATIONS

International Search Report issued by the International Searching Authority regarding International Application No. PCT/US2006/011231 (Aug. 1, 2006).

* cited by examiner

MULTITANK CONVEYOR-TYPE DISHWASHER AND AN OPERATING METHOD FOR IT

The invention relates to a multitank conveyor-type dishwasher and to an operating method for it.

Accordingly, the invention relates to a multitank conveyor-type dishwasher, in particular to a flight-type dishwasher or a rack-conveyor dishwasher.

A multitank conveyor-type dishwasher of the type described in the preamble of claim 1 is known from EP 0 838 190 B1.

Conveyor-type dishwashers are used in the commercial sector. In contrast to domestic dishwashers in which the item to be cleaned remains fixed in position in the machine during cleaning, in the case of conveyor-type dishwashers the item to be washed is conveyed through various spray zones of the conveyor-type dishwasher. Each spray zone has an associated tank which collects liquid which has been sprayed in the relevant spray zone. The conveyor-type dishwasher comprises in particular at least two spray zones which are in the form of wash zones in which soil, for example leftover food, is cleaned off the item to be washed.

In the case of multitank conveyor-type dishwashers, liquid is deflected counter to the conveying direction, in particular in the case of a large item to be washed, with the result that there may be too little liquid in a rear wash zone, as seen in the conveying direction. The deflection of liquid involves liquid which is sprayed onto the item to be washed in one wash zone, as seen in the conveying direction, flowing back into the previous wash zone.

The object of the invention is to eliminate a lack of liquid in a tank of a rear wash zone, as seen in a conveying direction, of a multitank conveyor-type dishwasher in a simple, cost-effective manner conserving resources.

According to the invention, this object is achieved by a multitank conveyor-type dishwasher according to claim 1 and by a method for operating a multitank conveyor-type dishwasher according to claim 11.

Further features of the invention can be found in the subclaims.

The lack of supply of fresh water needed to satisfy a rear wash zone can be avoided or reduced by recirculating liquid of a front wash zone, as seen in the conveying direction, to a rear wash zone, as seen in the conveying direction. This reduces the consumption of water by the multitank conveyor-type dishwasher. The reduced supply of fresh water lowers the consumption of detergent. Heating energy is also saved by recirculating liquid since the liquid of the front wash zone is generally at a higher temperature than fresh water.

The invention is described in the text which follows with reference to the drawings using preferred embodiments as examples.

In the drawings

During operation of a multitank conveyor-type dishwasher 2 according to the invention, when liquid is correspondingly required in a rear wash zone 6, as seen in a conveying direction 4, liquid of a front wash zone 8, as seen in the conveying direction 4, is supplied to this rear wash zone 6. In this case, "liquid of the front zone" always refers to a liquid which originates from the front zone, irrespective of whether the liquid is recirculated from the front zone itself or whether the liquid is recirculated to the front zone after it has flowed out of the front zone.

Figure 1:
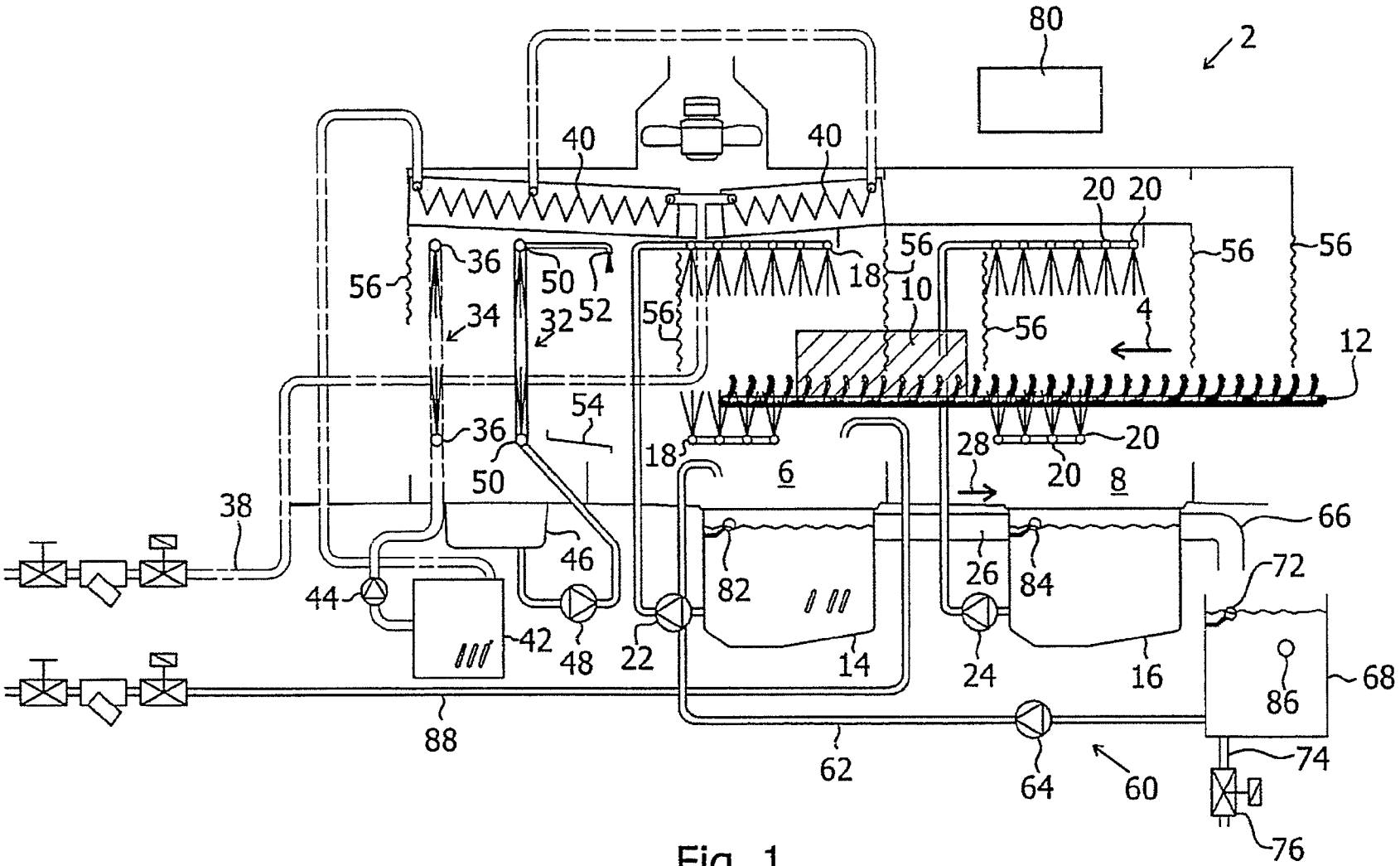
FIG. 1 shows a multitank conveyor-type dishwasher according to the invention.
Figure 2:
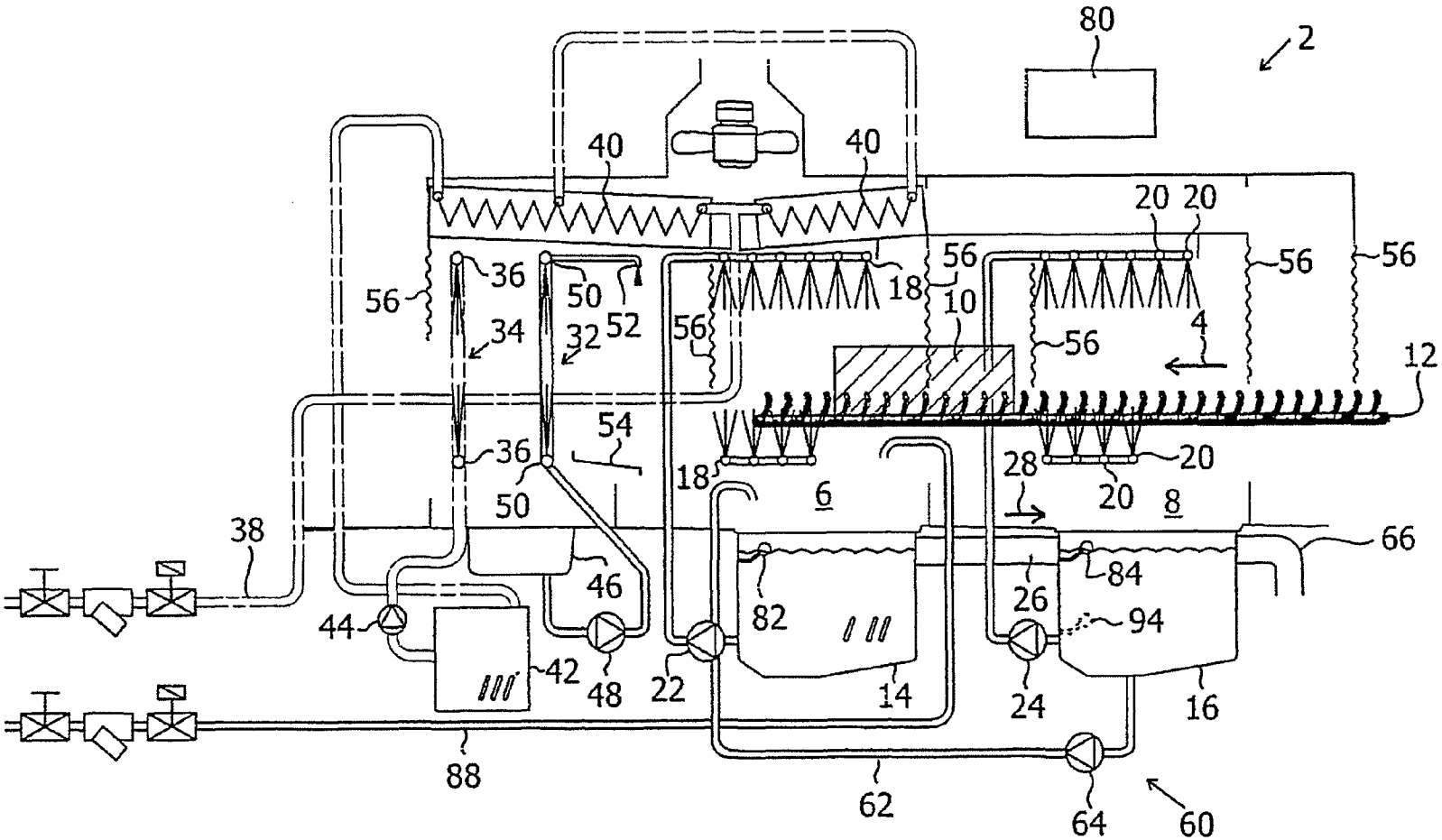
FIG. 2 shows a further embodiment of a multitank conveyor-type dishwasher according to the invention.
Figure 3:
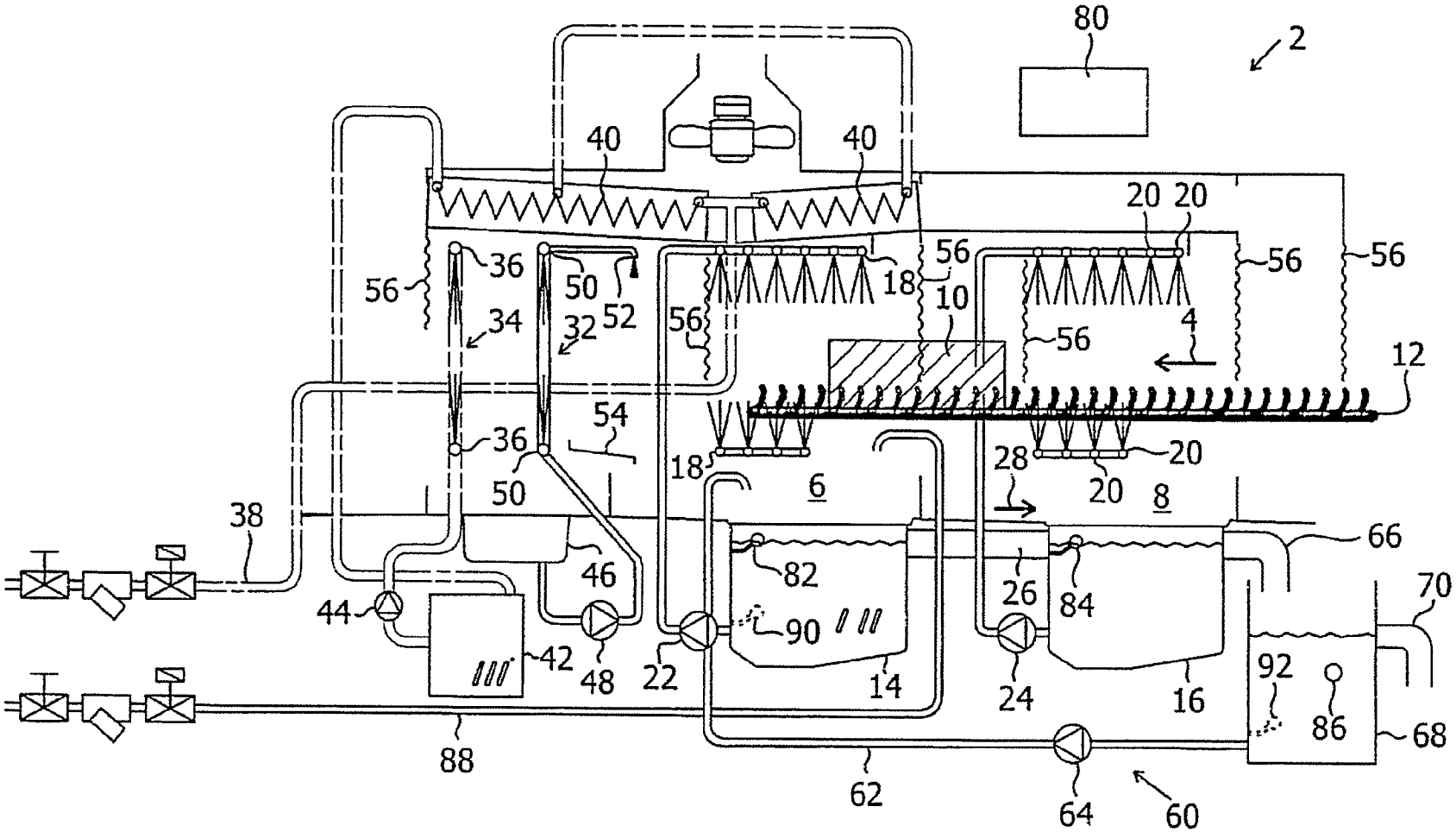
FIG. 3 shows another further embodiment of a multitank conveyor-type dishwasher according to the invention.

The embodiments of an inventive multitank conveyor-type dishwasher 2 for washing items 10 to be washed which are illustrated in FIG. 1, FIG. 2 and FIG. 3 have a conveying apparatus 12 for conveying the item 10 to be washed through the multitank conveyor-type dishwasher 2 in a conveying direction 4. A belt-conveying apparatus with an endless belt which has fingers for holding items 10 to be washed is illustrated in the drawings. The conveying apparatus 12 can furthermore be in the form of a rack-conveying apparatus.

The two wash zones 6, 8 are arranged in succession in the conveying direction 4, wherein each wash zone 6, 8 has an associated tank 14, 16 and associated spray nozzles 18, 20 for spraying liquid from the relevant tank onto the item 10 to be washed.

Each wash zone 6, 8 has an associated circulation pump 22, 24 for delivering liquid from the relevant tank 14, 16 to spray nozzles 18, 20 of the respective wash zone 6, 8. The spray nozzles 18, 20 can be arranged in a known manner, for example in a wall of the relevant zone or on a spray pipe, as illustrated in the drawings.

The front wash zone 8, as seen in the conveying direction 4, is in the form of a recirculating precleaning zone.

In a departure from the embodiments illustrated in the drawings, the front wash zone 8 may be in the form of a manual precleaning zone.

The rear wash zone 6, as seen in the conveying direction 4, is in the form of a main wash zone in which a wash liquid, such as detergent mixed with water, is circulated by means of the pump 22 and is sprayed onto the item 10 to be washed by means of the associated spray nozzles 18.

In each case two successive wash zones, here the two wash zones 6, 8, have an associated liquid forward-flow apparatus 26 for transferring liquid between these wash zones 6, 8 in a forward-flow direction 28 counter to the conveying direction 4.

In the illustrated embodiments, the liquid forward-flow apparatus 26 is formed by an overflow channel which connects the tanks 14, 16 of the relevant zones 6, 8 in terms of flow such that liquid from the tank 14 of the rear zone 6 automatically passes into the tank 16 of the front zone 8 when a liquid level in the rear tank exceeds a predetermined level. It is possible to provide a forward-flow line with or without pumping apparatus in place of the overflow channel, as is known, for example, from EP 0 838 190 B1.

In the embodiments illustrated in the drawings, a recirculating rinsing zone 32 and a fresh-water rinsing zone 34 follow the rear wash zone 6 in the conveying direction 4. Other refinements of the rinsing region, which in the present case comprises the said rinsing zones 32, 34, are also possible.

In the illustrated embodiments of the multitank conveyor-type dishwasher 2, liquid is supplied predominantly by means of continuous fresh-water rinsing which involves fresh-water rinsing liquid, which contains fresh water or comprises fresh water, being sprayed onto the item 10 to be washed from corresponding spray nozzles 36. The water is collected after the first spraying operation (final rinse) and then flows via a cascade system from tank to tank until it reaches the outflow.

The rinsing liquid is supplied to a heat exchanger 40 via a line 38, the said heat exchanger drawing off heat from the exhaust air and the water vapours of the multitank conveyor-type dishwasher 2 and preheating the rinsing liquid. The rinsing liquid is then conducted through a heating apparatus 42 which heats up the rinsing liquid further before it is supplied to the spray nozzles 36 of the fresh-water rinsing zone 34 in order to be sprayed by these spray nozzles 36 onto the item 10 to be washed. The heating apparatus 42 can be, for example, a boiler or a throughflow heater. The rinsing liquid can be delivered to the spray nozzles 36 using a pump 44 or by means of a sufficient water pressure prevailing in the relevant line.

A metering device for rinse aid and cleaner is not illustrated in the drawings; a metering device of this type can be provided at the locations which are customary for this.

The sprayed rinsing liquid flows into a tank 46 which is associated with both the fresh-water rinsing zone 34 and the pump rinsing zone 32. A rinsing pump 48 is provided for delivering the rinsing liquid from this tank 46 to the rinsing nozzles 50 by which the rinsing liquid is sprayed onto the item 10 to be washed.

Some of the rinsing liquid delivered by the rinsing pump 48 is supplied to one or more prerinsing nozzles 52. The rinsing liquid sprayed by the prerinsing nozzle 52 is used to remove the generally alkali cleaning liquid from the item 10 to be washed. After spraying, the rinsing liquid sprayed by the prerinsing nozzle 52 is supplied to the tank 14 of the rear wash zone 6 through at least one baffle plate 54, the said tank being continuously supplied with liquid in this way. A detergent may also be provided to tank 14.

In addition to the illustrated spray nozzles, further spray nozzles can be provided in the respective spray zones 6, 8, 32, 34.

As illustrated in FIG. 1 to FIG. 3, curtain elements 56 can be provided particularly at the edges of the spray zones of the multitank conveyor-type dishwasher 2, these curtain elements in particular acting as spray protection in order to reduce liquid unintentionally passing between the zones.

Liquid is deflected from the rear wash zone 6 into the front wash zone 8 and this may be so severe, in particular in the case of a large item 10 to be washed, that the continuous supply of liquid from zone 32 to zone 6 is not sufficient to compensate for the loss of liquid in zone 6.

According to the invention, a liquid recirculation apparatus 60 is provided for transferring sprayed liquid of the front wash zone 8, as seen in the conveying direction 4, into the rear wash zone 6 which is arranged downstream of the front wash zone 8, as seen in the conveying direction 4, counter to the forward-flow direction 28. In this way, a lack of liquid in the rear wash zone 6, which occurs on account of liquid being deflected, can be compensated for in particular.

As a result of liquid being recirculated counter to the forward-flow direction 28, the consumption of resources (water, chemicals, energy) is reduced in comparison to a corresponding machine that lacks such a forward-flow.

In the illustrated embodiments, the liquid recirculation apparatus 60 has a return line 62 and an associated recirculation pump 64 for pumping the liquid of the front wash zone 8 into the rear wash zone 6. Other refinements of the liquid recirculation apparatus are possible insofar as liquid of a front wash zone, as seen in the conveying direction, is or can be recirculated into a rear wash zone, as seen in the conveying direction, by the liquid recirculation apparatus.

In the illustrated embodiments, the liquid recirculation apparatus 60 is designed to supply liquid to the tank 14 which is associated with the rear wash zone 6. Furthermore, the liquid recirculation apparatus 60 can be designed to supply liquid to the spray nozzles 18 of the rear wash zone 6.

In the embodiments of a multitank conveyor-type dishwasher 2 illustrated in FIG. 1 and FIG. 3, the front wash zone 8 has an overflow 66 which issues into a collecting container 68, and the liquid recirculation apparatus 60 is designed to remove liquid of the front wash zone 8 from the collecting container 68. For this purpose, the return line 62 is connected to the collecting container 68.

As illustrated in FIG. 3, the collecting container 68 can have an overflow 70 through which liquid flows out from the collecting container 68 when the liquid level in the collecting container 68 is above the overflow 70. As an alternative, as illustrated in FIG. 1 and FIG. 2, the collecting container 68 can have a level sensor 72 and an outlet 74 with a controllable valve 76 which is opened or closed as a function of the liquid level detected by the level sensor 72.

In the embodiment of a multitank conveyor-type dishwasher 2 illustrated in FIG. 2, the liquid recirculation apparatus 60 is designed to remove liquid from the tank 16 which is associated with the front wash zone 8. For this purpose, the return line 62 is connected to the tank of the front wash zone 8.

The multitank conveyor-type dishwasher 2 has a control device 80 for controlling components of the multitank conveyor-type dishwasher 2, in particular for controlling the correspondingly designed liquid recirculation apparatus 60, here the recirculation pump 64.

The rear wash zone 6 has a level sensor 82 for detecting a liquid level in the tank 14 of the rear wash zone 6, wherein the control device 80 is designed to operate the liquid recirculation apparatus 60 as a function of the liquid level in the tank of the rear wash zone 6.

In the illustrated embodiments, the level sensor 82 is in the form of a level switch. For example, the control device 80 can be designed to operate the recirculation pump 64 when the liquid level in the tank of the rear wash zone 6 falls below the switching level of the level sensor 82. The switching level of the level sensor 82 can, for example, correspond to a setpoint level of the liquid in the tank 14 of the rear wash zone 6.

The front wash zone 8 has a level sensor 84, which is in the form of a level switch, for detecting a liquid level in the tank 16 which is associated with the front wash zone 8, and the control device 80 is designed to operate the liquid recirculation apparatus 60 as a function of the liquid level in the tank 16 of the front wash zone 8. A switching level of the level sensor 84 can, for example, correspond to a setpoint level of the liquid in the tank 16 of the front wash zone 8.

In the embodiments of FIG. 1 and FIG. 3, the control device operates the liquid recirculation apparatus 60 when the liquid level falls below a predetermined level value in the front wash zone 8. The liquid recirculation apparatus 60 then delivers liquid from the collecting container 68 to the tank of the rear wash zone 6, liquid flowing from the said tank into the tank of the front wash zone 8 by means of the liquid forward-flow apparatus 26 and raising the liquid level here. When the predetermined level value is reached in the front wash zone 8, the control device 80 switches off the liquid recirculation apparatus 60.

Level sensors which are designed to detect more than two level values may be provided in place of the level switches.

In place of the level sensors, or in addition to the level sensors, provision may be made for the amount of liquid supplied to the multitank conveyor-type dishwasher 2 and the corresponding amount of liquid which is flowing out, for example the amount of liquid flowing out of the rear wash zone 6, to be measured using corresponding flowmeters (not illustrated), and for the liquid recirculation apparatus 60 to be operated by the control device 80 to recirculate liquid into a rear wash zone 6 when the amount of liquid supplied to the multitank conveyor-type dishwasher is less than the amount of liquid flowing out.

The multitank conveyor-type dishwasher 2 illustrated in FIG. 1 and FIG. 3 has a turbidity sensor 86 for measuring the degree of contamination of the liquid of the front wash zone 8, and the control device 80 is designed to operate the liquid recirculation apparatus 60 as a function of the degree of contamination of the liquid of the front wash zone 8. The turbidity sensor 86 can be arranged in the collecting container 68, as illustrated in FIGS. 1 and 3. As an alternative or in addition, a turbidity sensor can be arranged in the tank 16 of the front wash zone 8 (not illustrated).

The embodiment of FIG. 2 does not have a turbidity sensor. In the case of this embodiment, a turbidity sensor can be arranged in the tank of the front wash zone 8 if required.

The control device 80 may be designed so that it operates the liquid recirculation apparatus 60 only if the degree of contamination of the liquid of the front wash zone 8 is below a predetermined degree of contamination. As a result, undesired contamination of the liquid in the tank 14 of the rear wash zone 6 can be avoided.

In order to be able to compensate for a lack of liquid in the tank 14 of the rear wash zone 6 even when the degree of contamination of the liquid of the front zone is too high, the tank 14 of the rear wash zone 6 may have an associated fresh-water supply apparatus 88, as illustrated in the drawings, using which fresh water can be supplied to the tank 14 of the rear wash zone 6, wherein the control device 80 is designed to operate the fresh-water supply apparatus 88 as a function of a fresh-water requirement and in this way supply fresh water to the tank 14 of the rear wash zone 6. Furthermore, the tank 16 of the front wash zone 8 may have an associated fresh-water supply apparatus 88, using which fresh water can be supplied to the front tank (not illustrated).

Fresh water may be required, for example, when there is too little liquid in the tank of the rear wash zone 6 and the degree of contamination in the tank of the front wash zone 8 is above a predetermined limit value. "Too little liquid in the tank 14 of the rear wash zone 6" may, in this case, mean that the level of liquid in the tank 14 of the rear wash zone 6 is below the switching level of the level sensor 82, for example that the level in the tank 14 of the rear wash zone is not sufficient to allow liquid to pass from the tank 14 of the rear zone 6 into the tank 16 of the front zone 8 via the liquid forward-flow apparatus 26. In addition to the level sensor 82, a further level sensor 90 may be arranged in the tank 14 of the rear wash zone 6 below the level sensor 82, as illustrated by dashed lines in FIG. 3 by way of example. In this case, "too little liquid in the tank 14 of the rear wash zone 6" may mean that the liquid level in the tank of the rear wash zone is below the switching level of the further level sensor 90. Even with high flexibility in terms of the liquid level in the tank of the rear zone, the further level sensor 90 ensures that enough liquid is available for the spray nozzles 18.

Instead of a degree of contamination which is above the predetermined limit value, a level which is below a minimum level of the liquid from the front wash zone 8 can be a condition for a fresh-water requirement. For example, in the case of a return line 62 which is connected to the collecting container 68, a level sensor 92, as illustrated by a dashed line in FIG. 3, which monitors a minimum level in the collecting container 68 may be provided in the collecting container 68. In this case, fresh water is required when the liquid level in the collecting container 68 is below the minimum level and liquid is required in the rear zone 6. In the case of a return line 62 which is connected to the tank 16 of the front wash zone 8, a level sensor 94, as illustrated by a dashed line in FIG. 2, which monitors a minimum level in the tank 16 can be provided in the tank 16 of the front wash zone 8. In this case, fresh water is required in the rear zone when the liquid level in the tank 16 of the front wash zone 8 is below the corresponding minimum level and liquid is required in the rear zone 6.

Furthermore, fresh water may be required, for example, when, in the embodiment of FIG. 2, the respective liquid level both in the tank 14 of the rear wash zone 6 and in the tank 16 of the front wash zone 8 is below the corresponding setpoint value.

According to the invention, one preferred embodiment of a multitank conveyor-type dishwasher 2, as illustrated in FIG. 1 and FIG. 3 for example, is designed and can be operated in such a way that a liquid requirement is detected in the rear wash zone, for example by a liquid level in a tank 14 of the rear wash zone 6 being detected, that the degree of contamination of the liquid of the front wash zone 8 is detected, and that, when liquid is required in the rear wash zone 6, liquid of the front wash zone 8 is supplied to the rear wash zone 6 if the degree of contamination is below a predetermined limit value, and that, when liquid is required in the rear wash zone 6, fresh water is supplied to the rear wash zone 6 if the degree of contamination is equal to the predetermined limit value or is above the predetermined limit value.

In order to meet the liquid requirement of the rear wash zone 6, provision may be made to supply both fresh water and also liquid of the front wash zone 8, for example simultaneously, successively or alternately at specific time intervals. For example, provision may be made for both fresh water and also liquid of the front wash zone 8 to be supplied to the rear wash zone 6 when the degree of contamination of the liquid of the front wash zone 8 is above a predetermined contamination limit value.

For the purposes of this description, the term "detection" includes in particular "automatic detection".

In a departure from the embodiments illustrated in the drawings, one or more further wash zones can be arranged between the front wash zone 8 (preclearing zone) and the rear wash zone 6 (main wash zone). In this case, provision may be made for the liquid recirculation apparatus 60 to be designed to remove liquid from a further wash zone and/or to transfer the removed liquid into a further wash zone.

The features of the described embodiments, in particular the features of the described embodiments relating to the level sensors and the turbidity sensors, can be combined with one another in any desired manner.

The invention claimed is:

1. Multitank conveyor-type dishwasher for washing items to be washed, comprising a conveying apparatus for conveying the item to be washed through the multitank conveyor-type dishwasher in a conveying direction; at least two cleaning zones which are arranged in succession in the conveying direction and a final-rinse zone downstream, as seen in the conveying direction, of the cleaning zones; wherein each cleaning zone has an associated tank and associated spray nozzles for spraying liquid from the associated tank onto the item to be washed; a liquid forward-flow apparatus between the two successive cleaning zones for transferring liquid between these cleaning zones in a forward-flow direction counter to the conveying direction; characterized in that a liquid recirculation apparatus is provided for transferring liquid, which has been deflected by the item to be washed counter to the conveying direction, from a front cleaning zone, as seen in the conveying direction, into a rear cleaning zone which is arranged downstream of the front cleaning zone, as seen in the conveying direction;

wherein the liquid recirculation apparatus has a recirculation line and an associated pump for pumping the liquid of the front cleaning zone into the rear cleaning zone; and wherein the liquid recirculation apparatus is designed to pump liquid to the tank which is associated with the rear cleaning zone.

2. Multitank conveyor-type dishwasher according to claim 1, characterized in that the liquid recirculation apparatus is designed to remove liquid of the front cleaning zone from the tank which is associated with the front cleaning zone.

3. Multitank conveyor-type dishwasher according to claim 1, characterized in that the front cleaning zone has an outlet which issues into a collecting container, and in that the liquid recirculation apparatus is designed to remove liquid of the front cleaning zone from the collecting container.

4. Multitank conveyor-type dishwasher according to claim 1, characterized in that a control device is provided for controlling components of the multitank conveyor-type dishwasher.

5. Multitank conveyor-type dishwasher according to claim 4, characterized in that the rear cleaning zone has at least one level sensor for detecting a liquid level in the tank which is associated with the rear cleaning zone, and in that the control device is designed to operate the liquid recirculation apparatus as a function of the liquid level in the tank of the rear cleaning zone.

6. Multitank conveyor-type dishwasher according to claim 4, characterized in that the front cleaning zone has at least one level sensor for detecting a liquid level in the tank which is associated with the front cleaning zone, and in that the control device is designed to operate the liquid recirculation apparatus as a function of the liquid level in the tank of the front cleaning zone.

7. Multitank conveyor-type dishwasher according to claim 4, characterized in that a turbidity sensor is provided for measuring the degree of contamination of the liquid of the front cleaning zone, and in that the control device is designed to operate the liquid recirculation apparatus as a function of the degree of contamination of the liquid of the front cleaning zone.

8. Multitank conveyor-type dishwasher according to claim 4, characterized in that the tank of the rear cleaning zone has an associated fresh-water supply apparatus, using which fresh water can be supplied to the tank of the rear cleaning zone, and in that the control device is designed to operate the fresh-water supply apparatus as a function of a fresh-water requirement of the rear cleaning zone.

9. A multitank conveyor-type dishwasher for washing items, comprising:

a conveying apparatus for conveying items through the multitank conveyor-type dishwasher in a conveying direction;

first and second cleaning zones that are arranged in succession in the conveying direction, wherein each of the first and second cleaning zones has an associated tank and associated spray nozzles for spraying liquid from the tank onto items;

a final-rinse zone downstream, as seen in the conveying direction, of the first and second cleaning zones;

a liquid forward-flow apparatus between the first and second cleaning zones for transferring liquid between the first and second cleaning zones in a forward-flow direction counter to the conveying direction;

a liquid recirculation apparatus for transferring liquid from the first cleaning zone into the second cleaning zone, the second cleaning zone arranged downstream of the first cleaning zone as seen in the conveying direction;

wherein the liquid recirculation apparatus has a recirculation line and an associated pump for pumping the liquid of the first cleaning zone into the second cleaning zone.

10. The multi-tank conveyor-type dishwasher according to claim 9, wherein the liquid recirculation apparatus delivers liquid to the tank associated with the second cleaning zone.

11. The multitank conveyor-type dishwasher according to claim 10, wherein the liquid recirculation apparatus removes liquid of the first cleaning zone from the tank associated with the first cleaning zone.

* * * * *